US008827302B2

(12) United States Patent
Fritschi et al.

(10) Patent No.: US 8,827,302 B2
(45) Date of Patent: Sep. 9, 2014

(54) AUTOMATIC HEEL UNIT FOR A SKI BINDING

(75) Inventors: Andreas Fritschi, Thun (CH); Stefan Ibach, Kirchdorf (CH); Theo Eggimann, Mühlethurnen (CH)

(73) Assignee: Fritschi AG-Swiss Bindings, Reichenbach im Kandertal (CH)

( * ) Notice: Subject to any disclaimer, the term of this patent is extended or adjusted under 35 U.S.C. 154(b) by 0 days.

(21) Appl. No.: 13/610,231

(22) Filed: Sep. 11, 2012

(65) Prior Publication Data

US 2014/0070519 A1 Mar. 13, 2014

(51) Int. Cl.
*A63C 9/00* (2012.01)

(52) U.S. Cl.
CPC ..... *A63C 9/00* (2013.01)
USPC ..... 280/623

(58) Field of Classification Search
CPC ..... A63C 9/02; A63C 9/0807; A63C 9/0846; A63C 9/00; A63C 9/086; A63C 9/006; A63C 9/08528; A63C 2009/008
USPC ..... 280/614, 616, 617, 618, 623, 626, 631
See application file for complete search history.

(56) References Cited

U.S. PATENT DOCUMENTS

| | | | | |
|---|---|---|---|---|
| 5,318,320 | A * | 6/1994 | Ramer | 280/614 |
| 5,735,541 | A * | 4/1998 | Fritschi et al. | 280/617 |
| 6,454,291 | B1 * | 9/2002 | Hillairet et al. | 280/623 |
| 7,401,802 | B2 * | 7/2008 | Walker et al. | 280/614 |
| 7,938,432 | B2 * | 5/2011 | Schlegel et al. | 280/601 |
| 2007/0228695 | A1 * | 10/2007 | Miette | 280/615 |
| 2008/0309053 | A1 * | 12/2008 | Mangold et al. | 280/614 |
| 2011/0018232 | A1 * | 1/2011 | Prigge et al. | 280/617 |
| 2011/0203138 | A1 * | 8/2011 | Shute et al. | 36/92 |
| 2012/0025489 | A1 * | 2/2012 | Meindl | 280/607 |
| 2013/0181427 | A1 * | 7/2013 | Fritschi | 280/614 |
| 2013/0334796 | A1 * | 12/2013 | Fritschi et al. | 280/614 |

FOREIGN PATENT DOCUMENTS

| | | | |
|---|---|---|---|
| EP | 0 199 098 | A2 | 10/1986 |
| EP | 1 679 099 | B1 | 12/2008 |
| EP | 2 351 603 | A2 | 8/2011 |
| WO | WO 2009/105866 | A1 | 9/2009 |
| WO | WO 2012/024809 | A1 | 3/2012 |

* cited by examiner

*Primary Examiner* — Katy M Ebner
*Assistant Examiner* — Brian Cassidy
(74) *Attorney, Agent, or Firm* — Birch, Stewart, Kolasch & Birch, LLP

(57) ABSTRACT

The invention relates to an automatic heel unit for a ski binding or touring ski binding, having a base element and a carriage which is mounted on the base element to be movable in the longitudinal direction of the ski. This automatic heel unit has at least one climbing position in which the carriage is situated in a rear position and a downhill position in which the carriage is situated further forward than in the climbing position. It comprises an adjusting lever for adjusting the automatic heel unit from the downhill position into the climbing position and back. This adjusting lever is mounted on the carriage to be pivotable about a pivot axle. Furthermore, the automatic heel unit comprises a lever element which is mounted on the base element to be pivotable about a first axle and mounted on the adjusting lever to be pivotable about a second axle.

15 Claims, 6 Drawing Sheets

AUTOMATIC HEEL UNIT FOR A SKI BINDING

TECHNICAL FIELD

The invention relates to an automatic heel unit for a ski binding, in particular a touring ski binding, having a base element for mounting the automatic heel unit on the upper side of a ski and having a carriage which is mounted on the base element so as to be movable in the longitudinal direction of the ski and on which there is arranged a heel retainer with at least one retention means for retaining a ski boot in a heel region of the ski boot. Said automatic heel unit has at least one climbing position, in which the carriage with the heel retainer is situated in a rear position and the heel region of a ski boot held in the ski binding is released. The automatic heel unit also has a downhill position in which the carriage with the heel retainer is situated further forward than in the at least one climbing position and the at least one retention means can interact with the heel region of a ski boot held in the ski binding in such a way that the ski boot is locked in a lowered position. The automatic heel unit furthermore comprises an adjusting lever for adjusting the automatic heel unit from the downhill position into the at least one climbing position and back.

PRIOR ART

In terms of function, ski bindings can be subdivided into downhill ski bindings, touring ski bindings, cross-country bindings and Telemark bindings. Downhill ski bindings are used only for downhill skiing and skiing on ski lifts, whereas touring ski bindings, in addition, are also used for walking on skis, in particular for climbing with the aid of climbing skins fastened on the skis, whereas cross-country bindings are used for cross-country skiing and Telemark bindings are used for skiing using the Telemark technique. Of these ski bindings, downhill ski bindings have only the task of ensuring reliable fixing of the ski boot to the ski in a so-called downhill position. By contrast, cross-country and Telemark bindings generally have only the task of retaining the ski boot so as to be pivotable about an axis oriented in the transverse direction of the ski, whereas touring ski bindings must have a downhill position and, for climbing purposes, must additionally be capable of being moved from the downhill position into a climbing position. In such a climbing position, the ski boot, as in the case of cross-country and Telemark bindings, can be pivoted about an axis oriented in the transverse direction of the ski, and can be lifted from the ski, as a result of which, for walking purposes, an articulated movement between the ski boot and the ski is permitted.

If a downhill position is additionally desired in the case of a cross-country and Telemark binding, then in the case of such a ski binding, as in the case of touring ski bindings, it is necessary for the ski binding to be capable of being moved both into a downhill position and also into a position corresponding to the climbing position, in which the ski boot is held so as to be pivotable about an axis oriented in the transverse direction.

For describing ski binding systems, a (fictitious) ski is often used as reference system, it being assumed that the binding is mounted on this ski. This custom is adopted in the present text. Therefore, the expression "longitudinal direction of the ski" means along the orientation of the longitudinal axis of the ski. Similarly, "parallel to the ski", for an elongate object, means oriented along the longitudinal axis of the ski. For a planar object, by contrast, the expression "parallel to the ski" means oriented parallel to the sliding surface of the ski. Furthermore, the expression "transverse direction of the ski" is intended to mean a direction transverse to the longitudinal direction of the ski, although it need not necessarily be oriented precisely at right angles to the longitudinal axis of the ski. Its orientation may also deviate somewhat from a right angle. The expression "centre of the ski", in turn, means a centre of the ski as seen in the transverse direction of the ski, while the expression "fixed with respect to the ski" means non-moveable in relation to the ski. In addition, it should be noted that some expressions which do not contain the word "ski" also refer to the reference system of the (fictitious) ski. Therefore, the expressions "front/forward/forwards/forwardly", "rear/rearward/rearwards/rearwardly", "top/above/upward/upwards/upwardly", "downwards/downwardly" and "lateral/laterally" relate to "front/forward/forwards/forwardly", "rear/rearward/rearwards/rearwardly", "top/above/upward/upwards/upwardly", "downwards/downwardly" and "lateral/laterally" of the ski. In the same way, expressions such as "horizontal/horizontally" and "vertical/vertically" refer to the ski, wherein "horizontal/horizontally" means located in a plane parallel to the ski and "vertical/vertically" means oriented perpendicularly to this plane.

Touring ski bindings, for their part, can be subdivided into two types. The first type is based on ski boots with rigid soles. In said touring ski bindings, the ski boot is, in its toe region, mounted pivotably in an automatic front unit mounted so as to be fixed with respect to the ski. The automatic heel unit of said touring ski bindings is attached to the ski at a distance from the automatic front unit adapted to a length of the ski boot sole, and in the downhill position, locks the ski boot in the heel region. In the climbing position, the heel of the ski boot is, by contrast, released from the automatic heel unit, as a result of which the ski boot can be raised from the ski and pivoted about the mounting at the automatic front unit. A representative of this type of touring ski binding is described for example in EP 0 199 098 A2 (Bartel Fritz). The second type of touring ski bindings, by contrast, comprises a ski boot carrier on which the ski boot is held by binding jaws. Here, in the climbing position, the ski boot carrier with the ski boot held therein is pivotable relative to the ski. In the downhill position, however, the ski boot carrier is locked in an orientation substantially parallel to the ski, as a result of which the ski boot held on the ski boot carrier is correspondingly fixed to the ski. A representative of said type of touring ski bindings is described for example in EP 1 679 099 B1 (Fritschi AG—Swiss Bindings). As a variation of this, it is also possible for the touring ski binding to comprise an automatic heel unit which is arranged on the ski and which permits a safety release in the forward direction. Said automatic heel unit, in the downhill position, locks the ski boot in its heel region, as a result of which the ski boot carrier, too, is locked in an orientation substantially parallel to the ski. By contrast, in the climbing position, the heel of the ski boot is released from the automatic heel unit and the ski boot can be pivoted together with the ski boot carrier relative to the ski, whereas the automatic heel unit remains on the ski.

Both in the case of automatic heel units of touring ski bindings of the first type, and also in the case of automatic heel units, which are arranged on the ski, of touring ski bindings of the second type, it is possible for the automatic heel unit to comprise a heel retainer which is mounted, so as to be displaceable relative to the ski, on a base element which is arranged so as to be fixed with respect to the ski. In this way, in the climbing position, the heel retainer can be situated in a rear position in which it is moved away from the heel of the ski boot and the heel region of the ski boot is released. By contrast, in the downhill position, the heel retainer, as a result of its displaceability, can be situated further forward on the ski in relation to the climbing position, and interact with the heel region of the ski boot. As a result of said interaction, the ski boot can be locked in its heel region. Examples of such automatic heel units are described in WO 2012/024809 A1 (Fritschi AG—Swiss Bindings) and in WO 2009/105866 A1 (Genuine Guide Gear Inc.).

The automatic heel unit described in WO 2012/024809 A1 comprises a base element which is fixed with respect to the ski and a heel retainer which is mounted on said base element so as to be displaceable in the longitudinal direction of the ski. Furthermore, said automatic heel unit comprises an adjusting lever by means of which the heel retainer can be moved in the longitudinal direction of the ski. In a first embodiment, for this purpose, the adjusting lever is mounted on the heel retainer so as to be pivotable about a pivot axle and is mounted on the base element by means of a slotted guide. Said embodiment has the disadvantage, however, that the slotted guide can easily become clogged with snow and ice and thus blocked. By contrast, in a second embodiment, the adjusting lever is mounted on the base element so as to be pivotable about a pivot axle, and abuts, with an element arranged below the pivot axle, in the rearward direction against a stop arranged on the heel retainer. Furthermore, the heel retainer is pushed forward by means of a spring. Therefore, if the adjusting lever is pulled upwards, that element of the adjusting lever which is arranged below the pivot axle presses against the stop on the heel retainer, as a result of which the heel retainer is moved rearward. By contrast, if the adjusting lever is pivoted downwards, the element of the adjusting lever frees up a space in front of the stop arranged on the heel retainer, as a result of which the heel retainer can be moved forward by the spring. Said design however has the result that, to move the automatic heel unit into the climbing position, the adjusting lever must be pulled up counter to the force imparted by the spring. Since the spring force is high, it is correspondingly the case that a large amount of force is required to be capable of pulling up the adjusting lever.

By comparison with said two embodiments, the automatic heel unit described in WO 2009/105866 A1 likewise comprises a base element which is fixed with respect to the ski, a heel retainer which is mounted on the base element so as to be displaceable in the longitudinal direction of the ski, and an adjusting lever. As in the second embodiment of WO 2012/024809 A1, the adjusting lever is mounted on the base element so as to be pivotable about a pivot axle. Furthermore, the automatic heel unit described in WO 2009/105866 A1 however also comprises a lever element which is mounted on the heel retainer so as to be pivotable about a first axle and mounted on the adjusting lever so as to be pivotable about a second axle. Here, the lever element is arranged behind the heel retainer and in front of the adjusting lever, and the first axle is situated in front of the second axle. Furthermore, the pivot axle and the second axle are arranged on the adjusting lever in such a way that the second axle is moved rearwards and upwards when the adjusting lever is pivoted rearward and downward about the pivot axle into an orientation parallel to the ski. With said movement of the second axle, the heel retainer is also pulled rearwards by means of the lever element. To permit an adequately long movement path of the heel retainer, the lever element and the distance between the pivot axle and the second axle must however be adequately large. As a result, the automatic heel unit takes up a large volume.

PRESENTATION OF THE INVENTION

The problem addressed by the invention is that of providing an automatic heel unit which falls within the technical field discussed in the introduction and in which the disadvantages described above are eliminated.

The solution to said problem is defined by the features of Claim 1. According to the invention, the adjusting lever is mounted on the carriage so as to be pivotable about a pivot axle, and in that the automatic heel unit comprises a lever element which is mounted on the base element so as to be pivotable about a first axle and mounted on the adjusting lever so as to be pivotable about a second axle.

Said design has the advantage that the automatic heel unit can be of very compact construction. One reason for this is for example that the adjusting lever is mounted on the carriage and is therefore moved forwards together with the carriage during a movement of the automatic heel unit into the downhill position. In this way, in the downhill position, the automatic heel unit is not extended but rather remains compact. A further reason is that the adjusting lever can be arranged in front of the lever element. In this way, when the adjusting lever is in a position oriented substantially parallel to the ski, it extends less far rearward than it would if it were arranged behind the lever element.

To achieve said advantages, the specific form of the adjusting lever is not of importance. The adjusting lever may for example be of horseshoe-shaped form, wherein the pivot axle and the second axle run through the two ends of the curved, horseshoe-shaped form. Here, the opposite curved region of the adjusting lever may be regarded as a free end of the adjusting lever and may for example point upwards, rearwards and upwards, rearwards or rearwards and downwards, depending on the position of the adjusting lever. The adjusting lever may however for example also have an elongate, bar-like form with a free lever-like end. Likewise, the adjusting lever may however also have the form of an adjusting disc. In the latter case, the adjusting lever may have a rounded form, a disc-shaped form or a form in the shape of a piece of cake, at the outer edge of which the adjusting lever can be operated similarly to a control wheel.

To achieve the advantages of the solution according to the invention, the specific form of the lever element is also not of importance. The lever element may for example be of bar-like form and mounted in the region of a first end so as to be pivotable about the first axle and mounted in the region of the second end so as to be pivotable about the second axle.

The lever element may however also, for example, be of disc-shaped or some other form. The lever element may for example have two regions which are oriented parallel to one another and which extend from the first axle to the second axle and which are connected to one another by a connecting region. Here, the connecting region may connect the two bar-like regions in the region of the first axle or in the region of the second axle or in between. Such a form of the lever element has the advantage that the lever element can be mounted, with broad support, about the first axle and about the second axle. In this way, improved stability can be attained, and a rotation of the lever element about an axis which perpendicularly intersects the first axle or the second axle or both the first axle and the second axle can for example be prevented. As a variant of this, however, it is also possible for two or more than two lever elements to be provided which are mounted so as to be arranged parallel to one another and pivotable jointly about the first axle and about the second axle.

Furthermore, for the solution to the problem on which the invention is based, it is not of importance whether the heel retainer is arranged movably on the carriage or whether the heel retainer is arranged fixedly on the carriage or is formed in one piece together with the carriage. Furthermore, it is also not of importance whether the heel retainer permits a safety release in the forward direction, in the sideward direction or even does not permit a safety release.

It is advantageously provided that a ski binding, in particular a touring ski binding, comprises an automatic heel unit according to the invention. Furthermore, a ski, in particular a touring ski, preferably comprises a ski binding having the automatic heel unit according to the invention. A preferred variant of this is however a ski binding with the automatic heel unit on its own, without a ski. Likewise, one advantageous variant is an automatic heel unit on its own.

It is preferable for the pivot axle, the first axle and the second axle to be oriented parallel to one another. This has the advantage that, during a pivoting movement of the adjusting lever and of the lever element about the pivot axle and about the first and second axles, the carriage with the heel retainer moves along a rectilinear path and, in so doing maintains the same orientation relative to the ski. As a variant of this, it is also possible for the pivot axle, the first axle and the second axle to be oriented in each case in the transverse direction of the ski. In this way, it can be achieved that, during a movement of the adjusting lever and of the lever element about the pivot axle, about the first axle and about the second axle, the carriage with the heel retainer can be moved in the longitudinal direction of the ski. In another variant, it is however also possible for the pivot axle, the first axle and the second axle to be oriented at some other angle relative to the ski.

As a variant of a parallel arrangement of the pivot axle, the first axle and the second axle, it is also possible, for example, for only the pivot axle and the first axle to be arranged parallel to one another. With such an arrangement, it can be achieved that, during a movement of the adjusting lever and of the lever element about the pivot axle and about the first and the second axle, the carriage with the heel retainer is not only displaced in the longitudinal direction of the ski but rather can also be tilted about an axis oriented in the longitudinal direction of the ski. This has the advantage that, in the climbing position, the heel retainer can be tilted away to the side.

As a further variant of this, however, it is possible for only the pivot axle and the second axle or else only the first axle and the second axle to be arranged parallel to one another. By means of such an arrangement of axles, during a movement of the adjusting lever and of the lever element about the pivot axle and about the first and the second axles, the carriage with the heel retainer can not only be displaced in the longitudinal direction of the ski but rather can also be tilted about an axis oriented in the longitudinal direction of the ski, and pivoted about an axis oriented vertically with respect to the ski. This has the advantage that, in the climbing position, the heel retainer can be both tilted away to the side and also pivoted away to the side.

As an alternative to this, it is however also possible for the pivot axle, the first axle and the second axle not to be oriented parallel to one another. In this case, the axles may be arranged in any desired way. In this case, the axles may however also be arranged non-parallel with respect to one another in such a way that, during a movement of the adjusting lever and of the lever element about the pivot axle and about the first and the second axles, the carriage with the heel retainer can not only be displaced in the longitudinal direction of the ski but rather can also be pivoted about an axis oriented vertically with respect to the ski.

It is advantageous for the adjusting lever to have, as viewed in a direction proceeding from the pivot axle, a free end at which the adjusting lever can be gripped and actuated. Here, the adjusting lever may, as already described, have for example an elongate form or a horseshoe-shaped form. In both cases, the free end is, as already mentioned, formed by the free end of the elongate form or by the curved region of the horseshoe-shaped form. By contrast, if the adjusting lever has a rounded form, a disc-shaped form or a form in the shape of a piece of cake, the outer edge of the adjusting lever is the free end, at which the control lever can be operated similarly to a control wheel.

As an alternative to this, it is however also possible for the adjusting lever to have no free end for actuation. In such an alternative, the adjusting lever may for example be of bar-like form, wherein the pivot axle is arranged in the region of one end and the second axle is arranged in the region of the other end of the adjusting lever. In this case, the adjusting lever may for example be designed such that it can be gripped between the pivot axle and the second axle and correspondingly actuated.

It is advantageous if, in the at least one climbing position, the free end of the adjusting lever is oriented rearwards and substantially parallel to the ski. This has the advantage that, from the orientation of the adjusting lever, it is possible to quickly identify that the automatic heel unit is situated in the at least one climbing position.

As a variant of this, in the at least one climbing position, the free end of the adjusting lever may also not be oriented rearwards and substantially parallel to the ski. It may for example also be provided that, in the at least one climbing position, the free end of the adjusting lever is oriented obliquely rearwards and downwards or obliquely rearwards and upwards.

It is preferable if, in the downhill position, the free end of the adjusting lever points obliquely rearwards and upwards. If, furthermore, in the at least one climbing position, the free end of the adjusting lever is oriented rearward substantially parallel to the ski or rearwards and downwards, then it is possible for the automatic heel unit to be moved into the downhill position by pulling up the free end of the adjusting lever. Furthermore, the automatic heel unit can be moved into the at least one climbing position by lowering the free end of the adjusting lever towards the ski. The latter may also be achieved by virtue of the ski and the free end of the adjusting lever being pushed together using one or two hands. Since it is the case that, when the automatic heel unit is moved into the at least one climbing position, the heel region of the ski boot is released from the automatic heel unit or even from the ski binding as a whole, the pushing-together of the ski and of the free end of the adjusting lever permits a type of emergency release of the emergency heel unit. Such an emergency release has the advantage that the ski boot can be released from the ski binding without a force being exerted on the foot or the leg of the skier. This is advantageous in particular in situations in which the skier has for example crashed and is possibly even injured.

As a variant of this, it may also be provided that, in the downhill position, the free end of the adjusting lever is not oriented obliquely rearwards and upwards. It may for example also be provided that, in the climbing position, the free end of the adjusting lever is oriented rearward substantially parallel to the ski or obliquely rearwards and upwards.

If, in the downhill position, the free end of the adjusting lever points obliquely rearwards and upwards, then it is advantageously the case that, in the downhill position, the free end of the adjusting lever is protected both to the front and also to the side. Here, the free end of the adjusting lever may be protected for example by a housing of the carriage or of the heel retainer. The free end of the adjusting lever may however also be protected by one or more climbing aid levers which, in the downhill position, point rearwards or obliquely rearwards and upwards. Such protection of the adjusting lever has the effect that, when the automatic front unit is in the downhill position during skiing, the adjusting lever cannot be inadvertently pushed downward, resulting in the adjusting lever being moved out of the downhill position. This correspondingly has the advantage of improved safety for the skier.

As a variant of this, it is however also possible for the adjusting lever to be protected only to the front or only to the side. The latter may be advantageous for example if the adjusting lever is already protected by the heel region of the ski boot, because said adjusting lever points steeply upwards in the downhill position. As a further variant, however, the adjusting lever may also be protected neither to the front nor to the side. This may be advantageous for example if the adjusting lever latches into an adequate latching position in the downhill position.

It is preferable for the pivot axle and the second axle to lie in a first plane. If, furthermore, the adjusting lever has a free end, then the direction in which the free end of the adjusting lever points as viewed from the pivot axle defines a straight line which advantageously intersects the first plane. This means that the free end of the adjusting lever advantageously does not lie in the first plane with the pivot axle and the second axle. To achieve this, it is for example possible for the straight line to intersect the first plane at right angles. It is however also possible for the straight line to intersect the first plane at some other, shallower angle. Regardless of the exact angle of intersection of the straight line with the first plane, said orientation of the free end of the adjusting lever relative to the pivot axle and the second axle has the advantage for example that the first plane can run from top at the front to bottom at the rear, while the free end of the adjusting lever points rearwards or rearwards and upwards. Correspondingly, the pivot axle may be arranged above and in front of, or else below and behind, the second axle in the first plane, wherein the skier can nevertheless easily grip and actuate the adjusting lever owing to the orientation of the free end of the adjusting lever.

As an alternative to this, it is however also possible for the pivot axle and the second axle to lie in the first plane together with the free end of the adjusting lever, or for the pivot axle and the second axle not to lie in the same plane.

It is preferable for the pivot axle and the second axle to lie in a first plane, wherein a first normal vector is oriented perpendicular to the first plane, and in the downhill position, points upwards from the first plane, and the first axle and the second axle preferably lie in a second plane, wherein a second normal vector is oriented perpendicular to the second plane and, in the downhill position, points upwards from the second plane, wherein in the at least one climbing position, the first normal vector and the second normal vector intersect at an angle of less than 160°, in particular less than 140°, in particular less than 120°. Here, the orientation of the first normal vector, which in the downhill position points upwards from the first plane, defines an orientation of the adjusting lever which relates to the arrangement of the pivot axle and the second axle. For said orientation, the orientation of the free end, which may be provided, of the adjusting lever is not of importance. However, if the adjusting lever has a free end and the direction in which the free end of the adjusting lever points as viewed from the pivot axle defines a straight line which intersects a first plane or which lies in said first plane, then said first plane is the same first plane to which, as per the above definition, the first normal vector is oriented perpendicular. Similarly to the orientation of the first normal vector, the orientation of the second normal vector which, in the downhill position, points upwards from the second plane defines an orientation of the lever element which relates to the arrangement of the first axle and the second axle. Here, both definitions are based on the fact that, in the downhill position, the respective normal vector points upwards. This means that the respective normal vector, proceeding from its point of intersection with the corresponding plane, lies within a hemisphere which is arranged above a plane which runs through the corresponding point of intersection and which is horizontal and thus parallel to the ski. If, as per said two definitions, the first plane and the second plane are oriented with upwardly pointing normal vectors parallel to one another or are identical, then the two normal vectors do not intersect and thus have an angle of intersection of 0°. If, by contrast, the first plane and the second plane are tilted relative to one another and the two normal vectors are oriented antiparallel to one another, then the angle of intersection of the two normal vectors is 180°. Correspondingly, the specification of the maximum angle of intersection of the two normal vectors in the at least one climbing position signifies an upper limit within which the pivot axle, the first axle and the second axle are arranged relative to one another in the at least one climbing position. Said upper limit has the advantage that, in the at least one climbing position, a geometry of the arrangement of the pivot axle, of the first axle and of the second axle is ensured proceeding from which the pivoting of the adjusting lever generates a desired movement of the lever element, whereby the automatic heel unit can be moved into the downhill position.

As an alternative to this, it may also be provided that, in the at least one climbing position, the pivot axle, the first axle and the second axle are oriented in some other way relative to one another.

It is advantageously provided that, in the downhill position of the automatic heel unit, the adjusting lever and the lever element are in a downhill configuration, wherein to move the automatic heel unit into the downhill position, the adjusting lever and the lever element can be pivoted relative to one another about a second axle in a first pivoting direction into the downhill configuration, wherein in a final segment of the pivoting movement into the downhill configuration, the pivot axle and the first axle are moved towards one another, and wherein in the downhill configuration, a further pivoting movement of the adjusting lever and of the lever element relative to one another in the first pivoting direction is blocked, whereby in the downhill position of the automatic heel unit, a further movement of the pivot axle and of the first axle towards one another is blocked. Since the carriage with the heel retainer is situated further forward in the downhill position than in the climbing position, it is the case that, during the movement of the automatic heel unit into the downhill position, the pivot axle and the first axle are moved away from one another before the final segment of the pivoting movement into the downhill configuration, and are only moved towards one another in the final segment of the pivoting movement. Therefore, in the downhill position, a rearwardly directed force acting on the heel retainer can be transmitted from the pivot axle via the adjusting lever and the lever element to the first axle and thus to the base element, without it being possible for the heel retainer to be inadvertently moved rearwards relative to the base element during skiing. This has the advantage that the ski boot can be held securely in a ski binding which comprises the automatic heel unit.

To stabilize the adjusting lever and the lever element in the downhill configuration, it is furthermore possible for the adjusting lever or the lever element or both the adjusting lever and also the lever element to be latched in a latching position in the downhill configuration. It may however also be provided that the adjusting lever and the lever element are not stabilized in the downhill configuration by latching into a latching position. In this case, the automatic heel unit may for example be held in the downhill position by virtue of the heel retainer being prevented from moving forwards. This may be realized for example by means of a ski boot which is held in a ski binding which comprises the automatic heel unit. Said ski boot is held between a front retention unit and the automatic heel unit, and thus prevents the heel retainer from moving forward, and the automatic heel unit from being capable of being moved out of the downhill position.

As a preferred variant of the downhill configuration described above, it may however also be provided that, in the downhill position of the automatic heel unit, the adjusting lever and the lever element are situated in some other downhill configuration in which the pivot axle, the first axle and the second axle are arranged in a common plane. In this way, it is likewise possible to obtain the advantage that the ski boot can be held securely in a ski binding which comprises the automatic heel unit, because the heel retainer cannot inadvertently be pushed rearwards in relation to the base element. To hold the adjusting lever and the lever element in said other downhill configuration, however, the adjusting lever or the lever element or both the adjusting lever and also the lever element should be capable of latching into a latching position in the downhill position.

As an alternative to said two variants, however, it may also be provided that, in the downhill position of the automatic heel unit, the adjusting lever and the lever element are in some other configuration.

The base element advantageously comprises a fastening element and an intermediate element, wherein the fastening element can be fastened to the ski and the intermediate element is mounted on the fastening element so as to be displaceable relative to the fastening element in the longitudinal direction of the ski. It is made possible in this way for the intermediate element to be displaced together with the carriage and the heel retainer relative to the fastening element and thus relative to the ski. Here, it is not of importance whether the carriage, for the adjustment of the automatic heel unit from the downhill position into the at least one climbing position, is mounted on the intermediate element or on the fastening element so as to be movable into a rear position and into a position further forward than the rear position. In both cases, there is the advantage that a position of the heel retainer relative to the ski can be adapted by displacement of the intermediate element. It is thereby possible, for example, despite the base element fixedly attached to the ski, for a ski binding which comprises the automatic heel unit to be adapted to ski boots of different boot size by virtue of the intermediate element being positioned in such a way that, in the downhill position of the automatic heel unit, the heel retainer just makes contact with the heel of the ski boot held in the ski binding. Furthermore, it can be achieved in this way for example that, in the downhill position of the automatic heel unit, the heel retainer can be moved rearwards relative to the fastening element and thus relative to the ski, whereby during skiing, continuous compensation of changes in distance between the automatic front unit and the automatic heel unit caused by bending of the ski during skiing is made possible.

As an alternative to this, it is however also possible for the base element not to comprise a fastening element and an intermediate element. It is for example possible for the base element to be fastened to the ski in the manner of a fastening element, and not to comprise an intermediate element which is displaceable in the longitudinal direction of the ski.

If the base element comprises a fastening element and an intermediate element, wherein the intermediate element is mounted on the fastening element so as to be displaceable relative to the fastening element in the longitudinal direction of the ski, then the first axle is preferably mounted on the intermediate element. This has the advantage that, by displacement of the intermediate element relative to the base element, the first axle and thus the lever element, the adjusting lever and the carriage with the heel retainer can be displaced relative to the fastening element and thus relative to the ski. It is correspondingly possible in this way, despite the base element fixedly attached to the ski, for a ski binding which comprises the automatic heel unit to be adapted to ski boots of different boot size by virtue of the intermediate element being positioned in such a way that, in the downhill position of the automatic heel unit, the heel retainer just makes contact with the heel of the ski boot held in the ski binding. Furthermore, it can be achieved in this way for example that, in the downhill position of the automatic heel unit, the heel retainer can be dynamically moved rearwards relative to the fastening element and thus relative to the ski, whereby during skiing, continuous compensation of changes in distance between the automatic front unit and the automatic heel unit caused by bending of the ski during skiing is made possible.

As an alternative to this, it is however also possible for the first axle not to be arranged on the intermediate element.

If the base element comprises a fastening element and an intermediate element, wherein the intermediate element is mounted on the fastening element so as to be displaceable relative to the fastening element in the longitudinal direction of the ski, it is advantageously provided that, in the downhill position, the intermediate element is movable dynamically relative to the fastening element in the longitudinal direction of the ski along a region. Here, the region along which the intermediate element is dynamically movable relative to the intermediate element may either be rectilinear or have a curved form. Furthermore, the region may be delimited in the forward direction by a front stop, by means of which the intermediate element is stopped and hindered in terms of its further freedom of movement. Independently of a front stop of said type, the region may be delimited in the rearward direction by a rear stop, by means of which the intermediate element is stopped and hindered in terms of its further freedom of movement. Here, a stop of said type may be arranged on the intermediate element, on the fastening element or on some other part of the automatic heel unit. Furthermore, a stop of said type may have two or more interacting elements which are arranged individually or together on the intermediate element, on the fastening element, on some other element of the automatic heel unit or on several of said elements. The delimitation of the region by a stop of said type may be advantageous if the intermediate element is mounted for example in a linear guide on the fastening element. In this case, it is possible to prevent the intermediate element from being able to be detached from the guide. As a variant of this, it is however also possible for the region not to be delimited by a stop, or to be delimited by a stop only in the forward direction or only in the rearward direction. Independently of this, the dynamic mobility of the intermediate element relative to the fastening element along the region in the downhill position has the advantage that, in the downhill position, the position of the heel retainer relative to the heel of the ski boot can be dynamically adapted by virtue of the intermediate element being moved together with the carriage and the heel retainer along the region. This permits, during skiing, continuous compensation of changes in distance between an automatic front unit and the automatic heel unit of the ski binding caused by bending of the ski during skiing. Correspondingly, the automatic heel unit makes it possible for the heel retainer to constantly maintain the same distance to the heel of the ski boot during skiing. In this way, the at least one retention means can interact in a constantly uniform manner with the heel of the ski boot and hold the ski boot locked in the lowered position. This firstly has the advantage that the ski is not stiffened, and that the skiing comfort for the skier is correspondingly increased. This secondly has the advantage that, in the variety of situations that arise during skiing, as uniform as possible a starting position for a safety release in the forward direction and, if provided, for a safety release in the sideward direction is ensured. Correspondingly, deviations from a preset force which must be overcome for a safety release in the forward direction or in the sideward direction are minimized, and the safety for the skier is increased. Here, it is not of importance whether the at least one retention means is composed of two pins directed substantially forwards, or whether the at least one retention means is of some other design.

As an alternative to this, it may however also be provided that, in the downhill position, the intermediate element is not dynamically movable relative to the fastening element in the longitudinal direction of a ski along a region.

If the base element comprises a fastening element and an intermediate element, wherein the intermediate element is mounted on the fastening element so as to be displaceable relative to the fastening element in the longitudinal direction of the ski and, in the downhill position, the intermediate element is movable dynamically relative to the fastening element in the longitudinal direction of the ski along a region, then it is preferably provided that, in the downhill position, the intermediate element is acted on with a forwardly directed force, and pushed in the direction of a forward end of the dynamic region, by an elastic element. Said elastic element may for example be a spring or an element of some other form with elastic properties. Here, the elastic element may exert a compressive force or a tensile force on the intermediate element. Furthermore, the elastic element may also constitute a plurality of elastic elements which are arranged adjacent to one another or in series. Independently of the specific design of the elastic element, the exertion with the forwardly directed force on the intermediate element has the advantage that changes in distance between the automatic front unit and the automatic heel unit caused by bending of the ski during skiing can be optimally compensated. Since the intermediate element with the carriage and the heel retainer is pushed against the heel of the ski boot by the force, it is provided here that a position of the intermediate element, of the carriage and of the heel retainer always adapts to the heel of the ski boot. Correspondingly, it is sufficient for the at least one retention means to be capable of interacting with the heel of the ski boot in such a way that the ski boot is prevented from performing a lateral pivoting movement and from performing an upward pivoting movement. In this case, the at least one retention means does not need to hold the heel retainer at a uniform distance to the heel of the ski boot and to move the heel retainer together with the carriage and the intermediate element along the dynamic path in the event of changes in distance between the automatic front unit and the automatic heel unit. The elastic element and the forwardly directed force exerted thereby on the intermediate element thus reduce the demands on the at least one retention means. Correspondingly, the at least one retention means can be more easily optimized so as to permit an optimally controlled safety release.

As an alternative to this, it may however also be provided that, in the downhill position, the intermediate element is not acted on with a forwardly directed force, and pushed in the direction of a front end of the dynamic region, by an elastic element. For example, it is also possible for at least one of the at least one retention means to be designed, and interact with the heel of the ski boot, in such a way that, in the downhill position of the automatic heel unit, the heel retainer is held at a uniform distance to the heel of the ski boot and that the heel retainer is moved dynamically along the region together with the carriage and the intermediate element in the event of changes in distance between the automatic front unit and the automatic heel unit.

It is preferable for the automatic heel unit to comprise, as retention means, two pins which in particular protrude in a forward direction from the heel retainer. Here, the two pins may be oriented parallel to the longitudinal axis of the ski or at an angle to the longitudinal axis of the ski. The two pins as retention means have the advantage that the load which the retention means have to withstand is distributed across several structural parts. Furthermore, this has the advantage that the automatic heel unit can for example permit a safety release by means of a movement of the retention means relative to one another. It is thus possible, for example, for a locking of the heel of the ski boot effected by the retention means to be releasable by virtue of the retention means of the different retention elements being moved toward or away from one another by the movement of the retention elements.

As a preferred variant of this, it is however also possible for the automatic heel unit to have a shell as a retention means, wherein the shell can engage around the sides, the bottom and the top of the heel of a ski boot to be retained. Examples of such shells as retention means are known from jaw-type bindings such as for example many downhill ski bindings or else from touring ski bindings of the second type mentioned in the introduction.

As an alternative to said two variants, the automatic heel unit may however also comprise at least one retention means which is of some other form. Independently of the type of the at least one retention means, it is achieved that, in the downhill position of the automatic heel unit, the heel region of a ski boot retained in the ski binding can be locked by the retention means.

Further advantageous embodiments and combinations of features of the invention will emerge from the following detailed description and from the patent claims in their entirety.

BRIEF DESCRIPTION OF THE DRAWINGS

In the drawings which are used for explanation of the exemplary embodiment.

Identical parts are basically denoted by the same reference numerals in the figures.

WAYS OF IMPLEMENTING THE INVENTION

Figure 1:
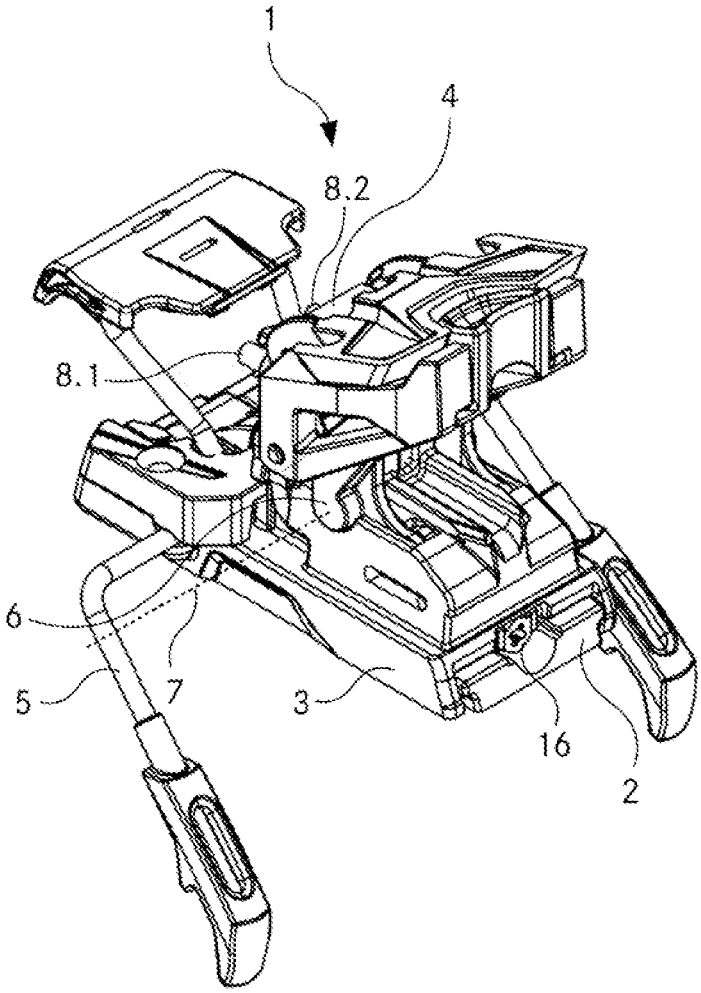
FIG. 1 shows an oblique view of an automatic heel unit according to the invention in a downhill position, FIG. 2*a, b, c, d* show in each case one side view of the automatic heel unit in the downhill position and in three climbing positions, FIG. 3*a, b, c* show schematic illustrations of a side view of the automatic heel unit with different lever positions for illustrating the coupling of an adjusting lever to a lever element.

FIG. 1 shows an oblique view of an automatic heel unit 1 according to the invention in a downhill position. Here, the automatic heel unit 1 is shown without a ski obliquely from the rear and above, such that the front of the automatic heel unit 1 is at the top left in the illustration and the rear of the automatic heel unit 1 is at the bottom right in the illustration, while the top and bottom in the illustration correspond to the top and bottom of the automatic heel unit 1. The longitudinal direction of the ski runs from top left to bottom right in the illustration, whereas the transverse direction of the ski runs from bottom left to top right.

The automatic heel unit 1 comprises a base element 2 which can be fixedly screwed to a ski in order to fasten the automatic heel unit 1 to the ski. Furthermore, the automatic heel unit 1 comprises a carriage 3 with a heel retainer 4 and a ski brake 5. Both the heel retainer 4 and also the ski brake 5 are generally known from touring ski bindings of the first type mentioned in the introduction. The heel retainer 4 shown here comprises two forwardly oriented pins 8.1, 8.2 as retention means, which pins can engage from the rear into recesses of a ski boot and thus retain the ski boot. Here, the heel retainer 4 permits a safety release in the forward direction in that the two pins 8.1, 8.2 can be pushed apart counter to a spring force. In one variant, the heel retainer 4 may furthermore permit a safety release in a sideward direction. Also, in a further variant, instead of the two pins 8.1, 8.2, the heel retainer 4 may have as retention means a concave shell form by means of which the heel of a ski boot can be retained. Such shell forms are known both from downhill bindings and also from touring ski bindings. They, too, may provide a safety release in the forward direction.

As is already known from some touring ski bindings, the carriage 3 is mounted on the base element 2 so as to be displaceable relative to the base element 2 in the longitudinal direction of the ski. In this way, the carriage 3 can be displaced together with the heel retainer 4 and the ski brake 5 relative to the base element 2 and thus relative to the ski. This makes it possible for the automatic heel unit 1 to be moved into a climbing position in which the carriage 3 is situated together with the heel retainer 4 in a rear position. This furthermore makes it possible for the automatic heel unit 1 to be moved into a downhill position, the carriage 3 with the heel retainer 4 being situated further forward in said downhill position than in the climbing position of the automatic heel unit 1. To adjust the automatic heel unit 1 from the downhill position into the climbing position and back, an adjusting lever 6 is mounted on the carriage 3 so as to be pivotable about a pivot axle 7. Since, in the present exemplary embodiment, the pivot axle 7 is mounted on the carriage 3 in the vicinity of the heel retainer 4 and the carriage 3 together with the heel retainer 4 comprise a common housing, it can also be said that the adjusting lever 6 is mounted on the heel retainer 4 so as to be pivotable about the pivot axle 7.

Here, in FIG. 1, the automatic heel unit 1 is shown in the downhill position. The carriage 3 with the heel retainer 4 is thus situated further forward in relation to the base element 2 than in the climbing position. As a result, the rear end of an adjusting screw 16 is visible at the rear end of the automatic heel unit 1 between the base element 2 and the carriage 3. Said adjusting screw 16 is oriented in the longitudinal direction of the ski and serves for adapting the position of the heel retainer 4 in the longitudinal direction of the ski to a ski boot of a desired boot side. For this purpose, the corresponding ski boot is inserted into a ski binding which comprises the automatic heel unit 1, and the automatic heel unit 1 is moved into the downhill position. The adjusting screw 16 is thereafter rotated until a front end of the heel retainer 4 just makes contact with the heel of the ski boot.

Figure 2A:
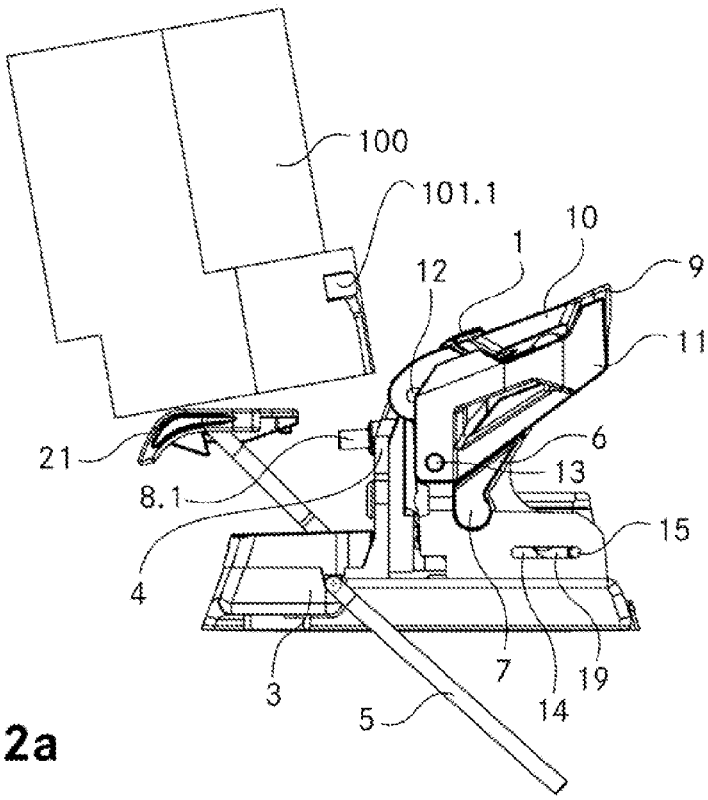
Figure 2B:
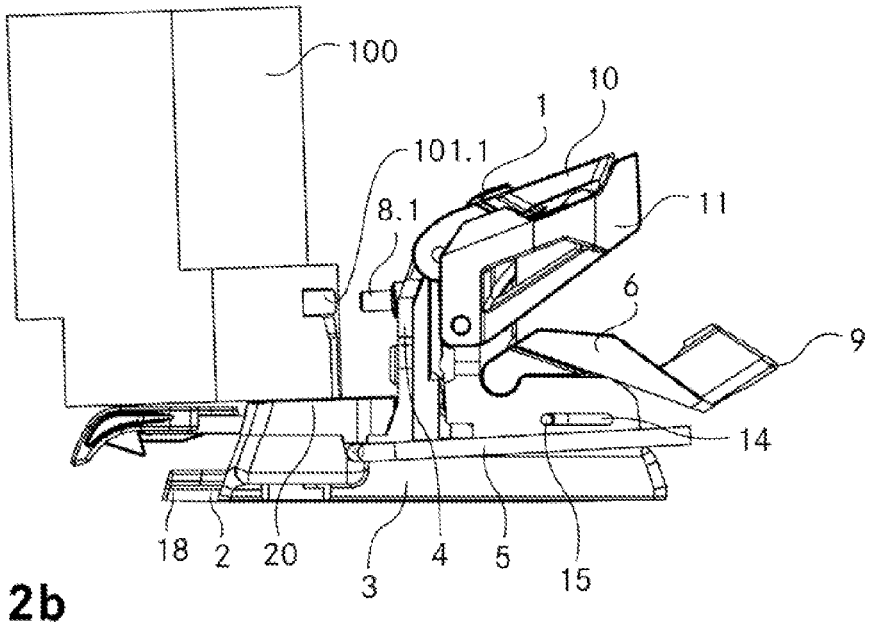
Figure 2C:
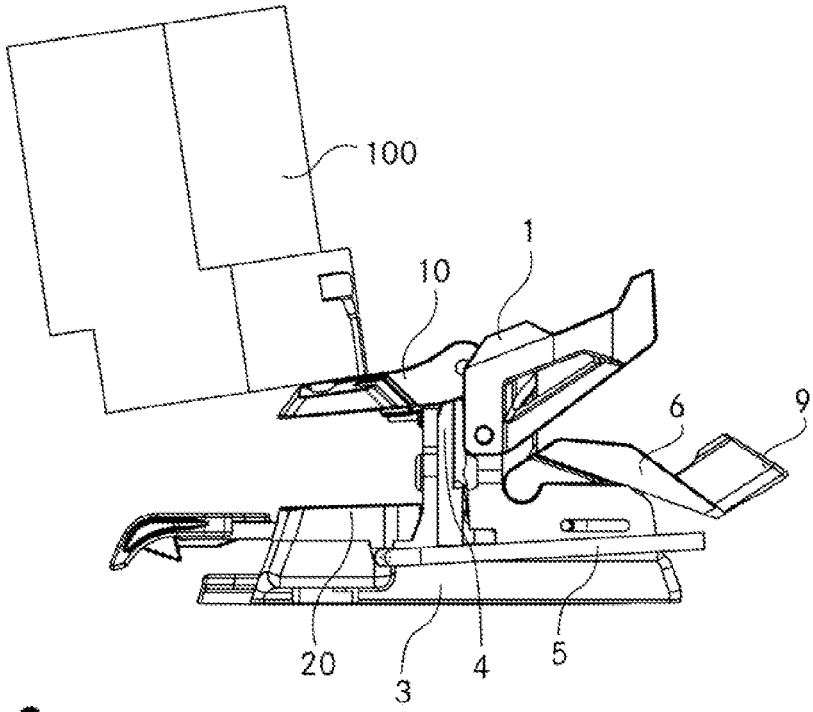
Figure 2D:
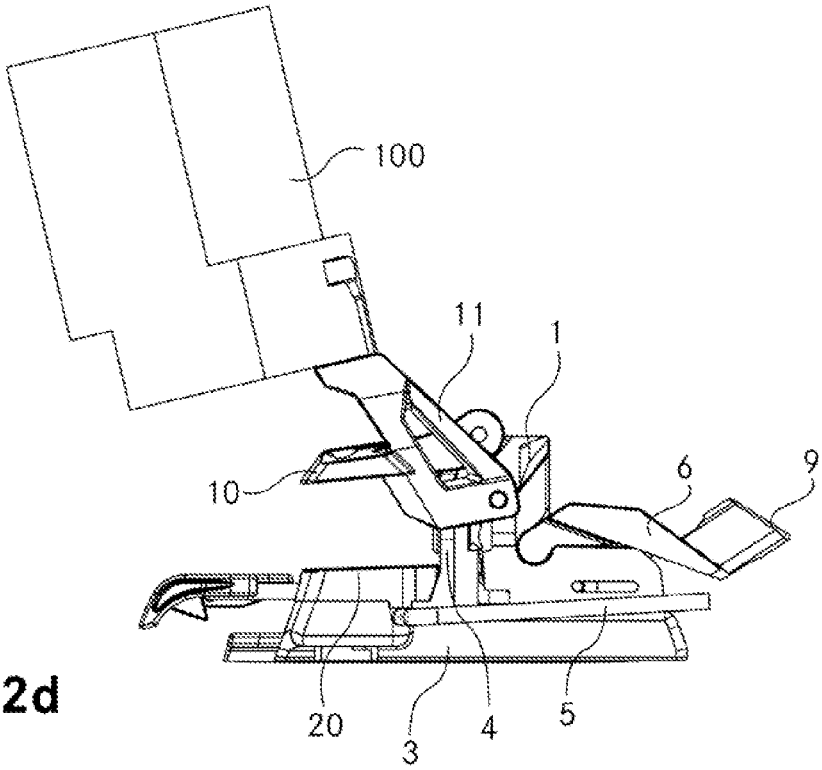

FIGS. 2*a*, 2*b*, 2*c* and 2*d* show in each case one side view of the automatic heel unit 1, wherein the automatic heel unit 1 is in the downhill position in FIG. 2*a*, whereas it is in a climbing position in each case in FIGS. 2*b*, 2*c* and 2*d*. In all four illustrations, the automatic heel unit 1 is oriented such that the front of the automatic heel unit 1 is at the left in the illustrations, whereas the rear of the automatic heel unit 1 is at the right in the illustrations. The top and bottom of the automatic heel unit 1 is in each case also at the top and bottom of the illustrations. Correspondingly, the longitudinal direction of the ski runs in each case horizontally in the plane of the illustration.

FIG. 2*a* shows the automatic heel unit 1 in the downhill position, as in FIG. 1. By contrast to FIG. 1, however, FIG. 2*a* additionally shows a heel of a ski boot 100 which is retained in a ski binding which comprises the automatic heel unit 1. Here, however, the ski boot 100 is illustrated as being retained only by the front retention device (not shown here) of the ski binding, and not, as is conventional in the downhill position, also by the automatic heel unit 1. This is owing to the fact that the ski boot 100 is shown with its heel pivoted upwards slightly, such as is the case during walking in a climbing position, whereby the heel of the ski boot 100 is situated a distance above the automatic heel unit 1. Said illustration shows one of two adjacently arranged pins 8.1 which point forwards from the heel retainer 4 and which, to retain the ski boot 100, can engage into two recesses 101.1 in the heel of the ski boot 100. It can also be seen from said illustration that, in the downhill position, the heel retainer 4 is positioned in the longitudinal direction of the ski in such a way that its front end just makes contact with a rear end of the heel of the ski boot 100. Said positioning of the heel retainer 4 is controlled by means of the adjusting screw 16 which is shown in FIG. 1 and by means of which an intermediate element 17 which belongs to the base element 2 is displaced in the longitudinal direction of the ski (see FIG. 4) relative to a fastening plate 18 which belongs to the base element 2. With such a movement of the intermediate element 17 relative to the fastening plate 18, a first axle 15 which is mounted on the intermediate element 17 is also displaced in the longitudinal direction of the ski. Said first axle 15 is oriented in the transverse direction of the ski and is guided in two elongate recesses 14 which are arranged in each case laterally on the carriage 3 and oriented horizontally. In the downhill position, the first axle 15 is situated in the region of a rear end of the two elongate recesses 14. Therefore, if the intermediate element 17 is displaced by means of the adjusting screw 16, the carriage 3 is also displaced together with the heel retainer 4 in the longitudinal direction of the ski.

To hold the first axle 15 in the region of the rear end of the two elongate recesses 14 in the carriage 3 in the downhill position, the first axle 15 is coupled to the adjusting lever 6 by means of a lever element 19. In the downhill position, said coupling has the effect that a distance between the first axle 15 and the pivot axle 7 is kept constant. This is also made possible by virtue of the fact that the adjusting lever 6 is situated in a downhill position and thereby holds the lever element 19 without permitting a movement of the lever element 19. In said downhill position of the adjusting lever 6, the free end 9 of the adjusting lever 6 points obliquely rearwards and upwards as viewed from the pivot axle 7. Here, the adjusting lever 6 runs largely within a recess on a lower side of a first climbing aid 10 and within a recess on a lower side of a second climbing aid 11. Said two climbing aids 10, 11 are mounted on the heel retainer 4 so as to be pivotable in each case about a separate axle 12, 13, and point obliquely rearwards and upwards. Here, the axle 13 about which the second climbing aid 11 is pivotable is arranged on the heel retainer 4 so as to be slightly higher and further forward than the pivot axle 7, whereas the axle 12 about which the first climbing aid 10 is pivotable is arranged on the heel retainer 4 so as to be slightly higher and further forward both than the pivot axle 7 and also than the axle 13.

Since, in the illustration of FIG. 2*a*, the heel of the ski boot 100 has not been lowered onto the automatic heel unit 1 and the automatic heel unit 1 is nevertheless in the downhill position, the ski brake 5 is in an activated position. However, if the heel of the ski boot 100 is lowered onto the automatic heel unit 1, the ski brake 5 is moved into a passive, non-braking position in which the sole of the ski boot 100 pushes a step plate 21 of the ski brake 5 downward towards the ski. However, if, in the downhill position, a safety release is performed and the ski boot 100 is released from the automatic heel unit 1, the ski brake 5 is moved into the activated position again by a spring force (not shown here).

By contrast to FIGS. 1 and 2*a*, the automatic heel unit 1 is shown in a first climbing position in FIG. 2*b*. As in FIG. 2*a*, said FIG. 2*b* additionally shows the heel of the ski boot 100 which is retained in a ski binding which comprises the automatic heel unit 1. Here, the ski boot 100 is again retained only by the front retention device (not shown) of the ski binding. By contrast to FIG. 2*a*, however, the ski boot 100 has been lowered toward the ski and is supported by a support element 20 arranged in front of the heel retainer 4 on the carriage 3. Said lowering of the ski boot 100 is possible in the first climbing position because the first climbing aid 10 and the second climbing aid 11 are, as in the downhill position, oriented obliquely rearwards and upwards. By contrast to the downhill position, however, in the first climbing position, the carriage 3 together with the heel retainer 4 has been displaced into a rear position, as a result of which the heel retainer 4 does not make contact with the heel of the ski boot 100 and the pins 8.1 do not engage into the recesses 101.1 in the heel of the ski boot 100. This can be seen in the illustration firstly from the fact that the carriage 3 has been displaced rearward in relation to the fastening plate 18 belonging to the base element 2. This can however also be seen secondly from the fact that the adjusting lever 6 is oriented with its free end 9 pointing horizontally rearwards, and that the first axle 15 is arranged at the front end of the elongate recesses 14 in the carriage 3.

Furthermore, in FIG. 2*b*, by contrast to FIG. 2*a*, the ski brake 5 is shown in a deactivated, non-braking position. Here, the ski brake 5 is blocked in said deactivated position such that it is not activated when the ski boot 100 is raised from the support element 20 during walking.

FIG. 2*c* shows the automatic heel unit 1 in a second climbing position. As in FIGS. 2*a* and 2*b*, said FIG. 2*c* also additionally shows the heel of the ski boot 100 which is retained in a ski binding which comprises the automatic heel unit 1. Here, the ski boot 100 is again retained only by the front retention device (not shown) of the ski binding.

As in the first climbing position, it is also the case in the second climbing position that the carriage 3 with the heel retainer 4 is situated in the rear position. Likewise, in the second climbing position, the adjusting lever 6 is also oriented with its free end 9 pointing horizontally rearward, and likewise, the ski brake 5 is also blocked in the deactivated position. By contrast to the first climbing position, however, the first climbing aid 10 has been pivoted forwards and supports the heel of the ski boot 100, such that the ski boot 100 can no longer be lowered toward the ski as far as the support element 20. Therefore, in FIG. 2*c*, the ski boot 100 is shown not as having been lowered as far as the ski, but rather as being supported above the support element 20 by the first climbing aid 10.

In FIG. 2*d*, the automatic heel unit 1 is shown in a third climbing position. As in FIGS. 2*a*, 2*b* and 2*c*, said FIG. 2*d* additionally shows the heel of the ski boot 100 which is retained in a ski binding which comprises the automatic heel unit 1. Here, the ski boot 100 is again retained only by the front retention device (not shown here) of the ski binding.

As in the first and second climbing positions, it is also the case in the third climbing position that the carriage 3 with the heel retainer 4 is situated in the rear position. Likewise, in the third climbing position, the adjusting lever 6 is oriented with its free end 9 pointing horizontally rearwards, and likewise, the ski brake 5 is also blocked in the deactivated position. By contrast to the first and second climbing positions, however, both the first climbing aid 10 and also the second climbing aid 11 have been pivoted forwards. Since the second climbing aid 11 points further upwards than the first climbing aid 10, the second climbing aid 11 supports the heel of the ski boot 100 in such a way that the ski boot 100 can no longer be lowered towards the ski as far as the first climbing aid 10 or as far as the support element 20. Therefore, in FIG. 2*d*, the ski boot 100 is shown not as having been lowered as far as the ski but rather as being supported above the support element 20 and above the first climbing aid 10 by the second climbing aid 11.

Figure 3A:
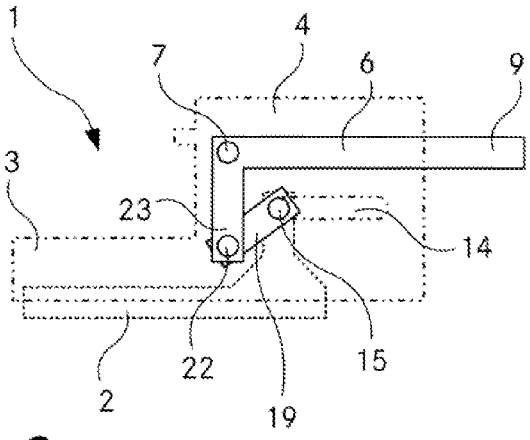
Figure 3B:
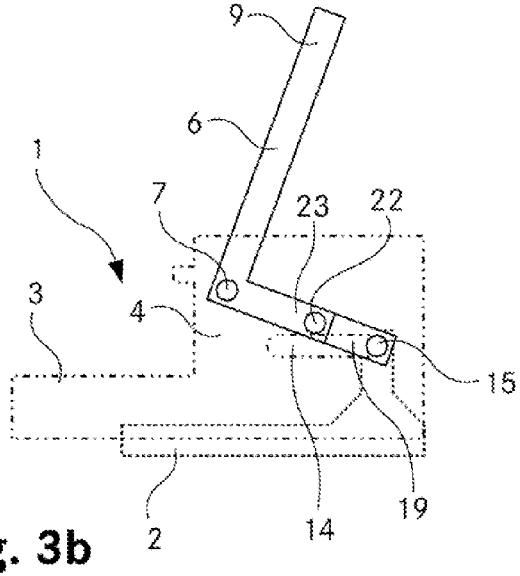
Figure 3C:
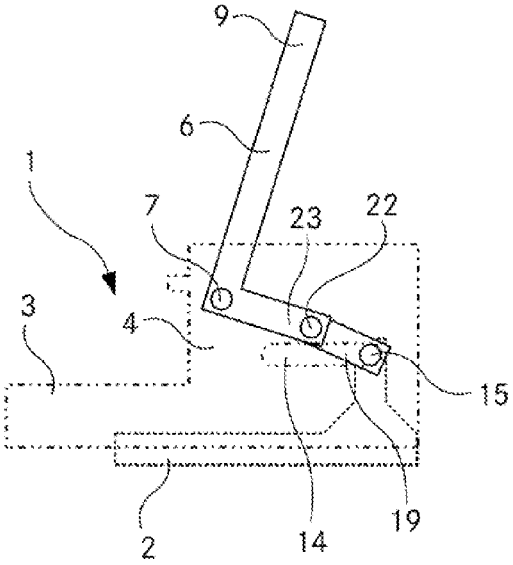

For illustration of the coupling of the adjusting lever 6 to the lever element 19, FIGS. 3*a*, 3*b* and 3*c* show in each case a schematic illustration of a side view of the automatic heel unit 1. Here, the illustration shows, in each case in schematically simplified form, the base element 2, the carriage 3 with the heel retainer 4, the adjusting lever 6 and the lever element 19. It can be seen from this that the adjusting lever 6 is mounted in front of the lever element 19 both in the downhill position and also in the climbing positions. The simplified illustration shows neither the intermediate element 17 nor the fastening plate 18 as a separate element of the base element 2. Even though this constitutes a simplification of the automatic heel unit 1, the illustration makes allowance for the fact that the base element 2, in one variant of the automatic heel unit 1, cannot be divided into an intermediate element 17 and a fastening plate 18.

In the illustration of FIG. 3*a*, the automatic heel unit 1 is situated in one of the three climbing positions shown in FIGS. 2*b*, 2*c* and 2*d*. Since the three climbing positions differ only by the positioning of the first and the second climbing aid 10, 11 and since the first and the second climbing aid 10, 11 are not shown in FIG. 3*a*, FIG. 3*a* is representative of all three climbing positions. The adjusting lever 6 is thus situated, as shown in FIGS. 2*b*, 2*c* and 2*d*, in the climbing position in which the free end 9 of the adjusting lever 6 points horizontally rearwards as viewed from the pivot axle 7. Furthermore, the carriage 3 with the heel retainer 4 is situated in the rear position relative to the base element 2, and the first axle 15 is situated at the front end of the elongate recesses 14 in the carriage 3.

By contrast to FIGS. 2*b*, 2*c* and 2*d*, it can be seen here in FIG. 3*a* that the adjusting lever 6 has, in the side view, an elongate form with a substantially right-angled corner therein. The pivot axle 7 runs through said corner. From the pivot axle 7, a first leg of the elongate form of the adjusting lever 6, pointing horizontally rearwards, leads to the free end 9 of the adjusting lever 6. Furthermore, proceeding from the pivot axle 7, a second limb of the elongate form of the adjusting lever 6 leads vertically downwards to a second end 23 of the adjusting lever 6. In the region of said second end 23, the lever element 6 is mounted on the adjusting lever 6 so as to be pivotable about a second axle 22 oriented in the transverse direction of the ski. Here, the lever element 19 points obliquely rearwards and upwards from the second axle 22, and is pivotably mounted there on the base element 2 by the first axle 15. A first plane in which the pivot axle 7 and the second axle 22 are situated is thus oriented vertically in the transverse direction of the ski, whereas a second plane in which the first axle 15 and the second axle 22 are situated is oriented horizontally in the transverse direction of the ski and from bottom at the front obliquely rearwards and upwards in the longitudinal direction of the ski.

FIG. 3*b* illustrates the automatic heel unit 1 during the transition from one of the three climbing positions into the downhill position. Here, the free end 9 of the adjusting lever 6 has been pivoted upwards about the pivot axle 7 in relation to the climbing positions and points obliquely rearwards and upwards. As a result of said movement, the second end 23 of the adjusting lever 6 is also moved rearwards and upwards, such that the first and the second plane are identical and therefore the pivot axle 7, the first axle 15 and the second axle 22 lie in a plane. In said position of the transition between the climbing positions and the downhill position, the distance between the pivot axle 7 and the first axle 15 is at its greatest. The carriage 3 with the heel retainer 4 is therefore situated in its furthest forward position in relation to the base element 2. Correspondingly, in said position, the first axle 15 is situated at the rear end of the elongate recesses 14 in the carriage 3.

FIG. 3*c* illustrates the automatic heel unit 1 in the downhill position. Here, the free end 9 of the adjusting lever 6 is shown as having been pivoted slightly further upwards than in the transition position shown in FIG. 3*b*. As a result, the second end 23 of the adjusting lever 6 has also been pivoted slightly further upwards, and abuts against a stop on the inner side of the heel retainer 4, as a result of which a further movement of the adjusting lever 6 is blocked. In said position of the adjusting lever 6, the first plane and the second plane intersect at a small angle, and the pivot axle 7, the first axle 15 and the second axle 22 no longer lie in a common plane. As a result, the distance between the pivot axle 7 and the first axle 15 is slightly smaller than in the illustration of FIG. 3*b*. Correspondingly, the carriage 3 with the heel retainer 4 is also situated slightly further rearward in relation to the base element 2. Since, in the downhill position, the stop on the inner side of the heel retainer 4 prevents a further movement of the adjusting lever 6 and of the lever element 19 in the same direction as that in which they move during the transition into the downhill position, a force which acts rearwards on the heel retainer 4 from the front is transmitted via the pivot axle 7 to the adjusting lever 6 and from the latter to the second axle 22 and the lever element 19 and also to the first axle 15 and the base element 2. This prevents the heel retainer 4, in the downhill position of the automatic heel unit 1, from being capable of being inadvertently pushed rearwards by the ski boot 100 during skiing. Since the adjusting lever 6, in said position, is furthermore latched on the heel retainer 4 in a latching position, the automatic heel unit 1 is also prevented from being capable of being inadvertently moved out of the downhill position.

Figure 4:
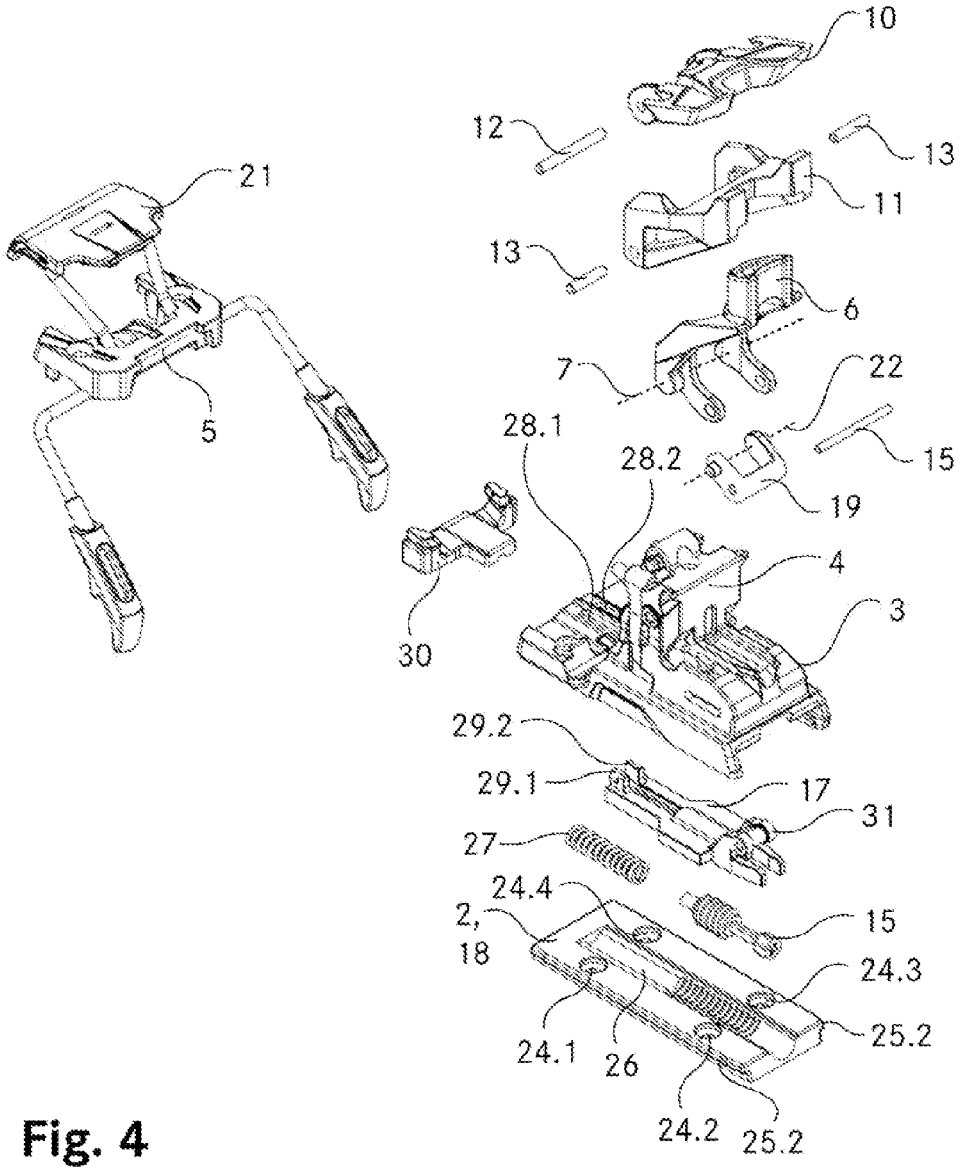
FIG. 4 shows an exploded illustration of the automatic heel unit as viewed obliquely from the rear and above, and FIG. 5*a, b, c* show in each case one vertically oriented cross section, running in the longitudinal direction of the ski, of the automatic heel unit in a first climbing position.

FIG. 4 shows an exploded illustration of the automatic heel unit 1 obliquely from the rear and above. Therefore, the front of the automatic heel unit 1 is at the top left in the illustration and the rear of the automatic heel unit 1 is at the bottom right in the illustration, whereas the top and bottom in the illustration correspond to the top and bottom of the automatic heel unit 1. The longitudinal direction of the ski thus runs from top left to bottom right in the illustration, while the transverse direction of the ski runs from bottom left to top right.

From the exploded illustration, it is possible to see that the base element 2 comprises a fastening plate 18 and also an intermediate element 17 which is mounted on the fastening plate 18 so as to be displaceable in the longitudinal direction of the ski. It can also be seen that the fastening plate 18 has a substantially rectangular form and has four openings 24.1, 24.2, 24.3, 24.4 which are arranged in a rectangle and which run from top to bottom through the fastening plate 18. Screws can be guided through said openings 24.1, 24.2, 24.3, 24.4 for the purpose of fastening the fastening plate 18 and thus the automatic heel unit 1 to a ski. Along the two side edges which run in the longitudinal direction of the ski, the fastening plate 18 furthermore has in each case one rail 25.1, 25.2 by means of which the carriage 3 is guided on the fastening plate 18 so as to be displaceable in the longitudinal direction of the ski. Furthermore, the fastening plate 18 has, in its surface and in the centre of the fastening plate 18 as viewed in the transverse direction of the ski, a recess 26 which is oriented in the longitudinal direction of the ski and which has a substantially semicircular cross section. Said recess 26 extends from a rear end of the fastening plate 18 into a region of a front end of the fastening plate 18. On a rectangular base surface which is slightly wider than the semicircular cross section of the recess 26, the recess 26 is sunken slightly into the surface of the fastening plate 18. In this way, the intermediate element 17 is guided laterally, above the semicircular form, by the recess 26 and is movable along the fastening plate 18 in the longitudinal direction of the ski.

In a manner coordinated with the semicircular region of the recess 26 of the fastening plate 18, a recess which is likewise oriented in the longitudinal direction of the ski and which has a semicircular cross section is situated in the underside of the intermediate element 17. Said recesses is situated immediately above the semicircular region of the recess 26 in the surface of the fastening plate 18. To be able to displace the intermediate element 17 in a controlled manner in the longitudinal direction of the ski, the adjusting screw 16 and a spiral spring 27 which is oriented in the longitudinal direction of the ski are inserted in the recess in the underside of the intermediate element 17. Here, the adjusting screw 16 and the spiral spring 27 are mounted in the intermediate element 17 in such a way that the thread of the adjusting screw 16 abuts rearwardly against a rear wall of the intermediate element 17 and forwardly supports the spiral spring 27, and that the spiral spring 27 is braced between the thread of the adjusting screw 16 and a front wall of the intermediate element 17. Since the thread of the adjusting screw 16 protrudes downwardly out of the intermediate element 17 and into the thread in the recess 26 in the fastening plate 18, the intermediate element 17 can be displaced forwards and backwards by rotating the adjusting screw 16. It is however furthermore possible for the intermediate element 17 to also be pushed rearwards slightly by a rearwardly directed force counter to the spring force of the spiral spring 27. Since, in the downhill position, as described further above, the carriage 3 with the heel retainer 4 is in a fixed position relative to the intermediate element 17, it is thus possible for the position of the heel retainer 4 relative to the fastening plate 18 and thus relative to the ski to be adjusted by means of the adjusting screw 16. Furthermore, the heel retainer 14 can be moved rearward together with the intermediate element 17 counter to the spring force of the spiral spring 27. In this way, changes in distance between the automatic heel unit 1 and an automatic front unit, which belongs to the same ski binding, caused by bending of the ski during skiing can be optimally compensated.

The intermediate element 17 and the fastening plate 18 are held together by the carriage 3 which is guided, so as to be movable in the longitudinal direction of the skis, by the rails 25.1, 25.2 on the sides of the fastening plate 18 and which encloses the intermediate element 17 from above. Here, the carriage 3 has, in front of the heel retainer 4, a front region in which the carriage 3 is considerably lower than the heel retainer 4. In said front region there are arranged two parallel slots 28.1, 28.2 which are oriented in the longitudinal direction of the ski. Two pegs 29.1, 29.2 which are arranged at the top on the intermediate element 17 at the front end of the intermediate element 17 are guided in said slots 28.1, 28.2 so as to be movable in the longitudinal direction of the ski. In this way, the freedom of movement of the carriage 3 in the longitudinal direction of the ski relative to the intermediate element 17 is restricted to the length of the slots 28.1, 28.2.

In the assembled state of the automatic heel unit 1, the ski brake 5 is fastened on the front region of the carriage 3 with the two slots 28.1, 28.2. Between the carriage 3 and the ski brake 5 there is furthermore mounted a retainer 30 which is displaceable slightly relative to the carriage 3 and the ski brake 5 in the longitudinal direction of the ski. Said retainer 30 is additionally mounted on the two pegs 29.1, 29.2 and displaceable relative to the two pegs 29.1, 29.2 by a small distance in the longitudinal direction of the ski. Therefore, if the carriage 3 is situated in the rear position in one of the climbing positions, then the retainer 30 is moved forward slightly in relation to the carriage 3, whereas said retainer is moved rearward in relation to the two pegs 29.1, 29.2. By contrast, if the carriage 3 is in the downhill position, the retainer 30 is moved rearward relative to the carriage 3 and forward relative to the pegs 29.1, 29.2. Since the ski brake 5 is moved forward or rearward in each case together with the carriage 3, it is the case that, in the downhill position, the retainer 30 is at a distance behind the ski brake 5 and does not interact with the step plate 21 of the ski brake 5. By contrast, when the automatic heel unit 1 is in one of the climbing positions, the carriage 3 with the ski brake 5 is pulled rearward relative to the retainer 30, as a result of which the retainer 30 interacts with the step plate 21 of the ski brake 5 and blocks the ski brake 5 in the deactivated position.

To move the carriage 3 together with the ski brake 5 and the heel retainer 4 forwards and backwards relative to the intermediate element 17, the heel retainer 4 is, as already mentioned, mounted on the intermediate element 17 by means of the adjusting lever 6 and the lever element 19. For this purpose, there is arranged on the rear end of the intermediate element 17 a bearing 31 in which the first axle 15 is mounted so as to be oriented in the transverse direction of the ski. Said bearing 31 has, in the rearward and upward direction, a rounded form which is concentric with the first axle 15. The lever element 19, for its part, comprises a region which is oriented in the transverse direction of the ski, and two parallel arms oriented perpendicular to said region. In each case one of said two arms is arranged on one of the ends of that region of the lever element 19 which is oriented in the transverse direction of the ski. Here, in each case one shoulder of the arm is connected to the region oriented in the transverse direction of the ski, and one free end of the arm points away from the shoulder of the arm, wherein both arms point in the same direction. On those sides of the two arms which face away from one another, there is arranged on each arm, in the region of the free end of the corresponding arm, a peg which has a circular cross section. Said two pegs are in each case oriented concentrically with respect to the second axle 22. That region of the lever element 19 which is oriented in the transverse direction of the ski has an elongate form with a concave cross section which is arranged concentrically around the longitudinal axis of the lever element. In the assembled state of the automatic heel unit 1, said region is arranged concentrically around the first axle 15, and engages with its concave form around the rounded form of the bearing 31 of the intermediate element 17. At the same time, the shoulders of the two arms engage around the bearing 31 at both sides. In this way, the lever element 19 is prevented from being capable of being moved relative to the intermediate element 17 in the transverse direction of the ski. In order, in said arrangement, to mount the lever element 19 with the two arms on the intermediate element 17 so as to be pivotable about the first axle 15, the first axle 15 runs through openings in the shoulders of the two arms of the lever element 19 and through the bearing 31 on the intermediate element 17.

The adjusting lever 6 is of substantially horseshoe-shaped form. Here, the curved end of the adjusting lever 6 forms the free end 9 of the adjusting lever 6 which can be gripped by the skier and actuated by the skier. The two arms of said horseshoe-shaped form are arranged adjacent to one another in the transverse direction of the ski and so as to run parallel to one another. Both arms have in each case one end with an opening oriented in the transverse direction of the ski. In the assembled state, there is mounted in said openings in each case one peg of the lever element 19, whereby the lever element 19 is connected to the adjusting lever 6 so as to be pivotable about the second axle 22. Set back slightly from the ends of the arms of the adjusting lever 6, the two arms of the adjusting lever 6 have in each case one bearing by means of which the adjusting lever 6 is mounted on the heel retainer 4 so as to be pivotable about the pivot axle 7. In the region of said bearings, the arms of the adjusting lever 6 are curved such that the ends of the arms do not lie in the same plane as the two bearings and the free end 9 of the adjusting lever 6. Said curvature of the arms has the effect that the ends of the arms point obliquely rearwards and downwards from the pivot axle 7 when the free end 9 of the adjusting lever 6 points obliquely rearwards and upwards from the pivot axle 7.

As already mentioned, the first and the second climbing aid 10, 11 are mounted on the heel retainer 4 in front of and above the pivot axle 7 and so as to be pivotable about axles 12, 13.

Figure 5A:
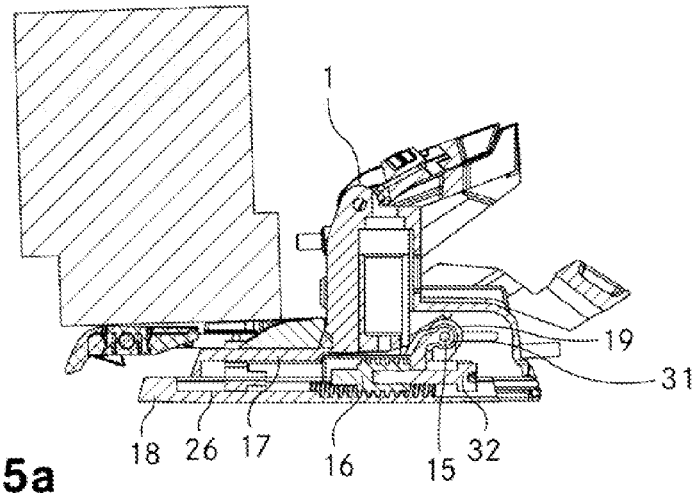
Figure 5B:
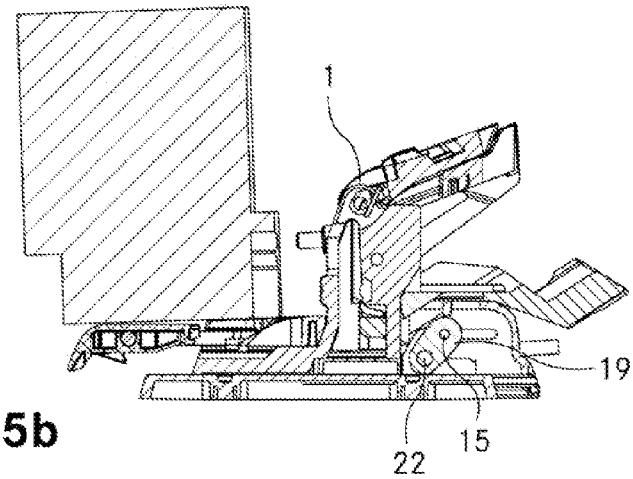
Figure 5C:
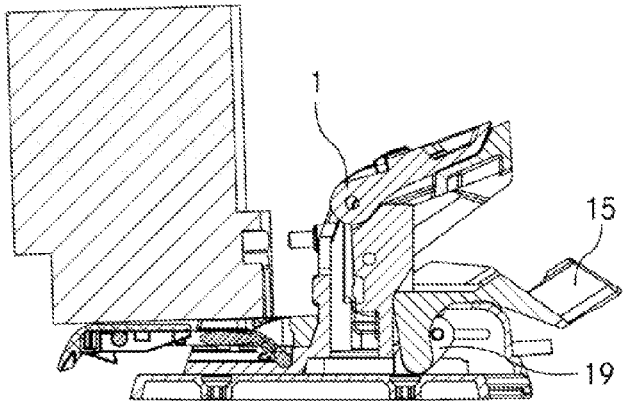

FIGS. 5*a*, 5*b* and 5*c* show in each case a vertically oriented cross section, running in the longitudinal direction of the ski, of the automatic heel unit 1 in the first climbing position. The front of the automatic heel unit 1 is in each case at the left in the illustrations, whereas the rear of the automatic heel unit 1 is in each case at the right in the illustrations. The top and bottom in the illustrations correspond in each case also to the top and bottom of the automatic heel unit 1.

The cross section shown in FIG. 5*a* runs through a centre of the automatic heel unit 1 as viewed in the transverse direction of the ski. It can be seen from this how the intermediate element 17 is mounted on the fastening plate 18 and how the thread of the adjusting screw 16 engages into the thread in the recess 26 in the fastening plate 18. It can also be seen that the adjusting screw 16 is assembled from a threaded element and a further element with the screw head 32. It can also be seen how the lever element 19 engages, with its region oriented in the transverse direction of the ski, around the bearing 31 and the first axle 15.

The cross section illustrated in FIG. 5*b* runs through the automatic heel unit 1 offset laterally slightly in the transverse direction of the ski in relation to the cross section of FIG. 5*a*. Here, the cross section is positioned such that the section area runs through one of the arms of the lever element 19. It can thus be seen how the lever element 19 is oriented in the first climbing position, and where the first axle 15 and the second axle 22 are mounted on the arm of the lever element 19.

The cross section illustrated in FIG. 5*c* runs through the automatic heel unit 1 offset laterally slightly further in relation to the cross section illustrated in FIG. 5*b*. Here, the section area runs through one of the arms of the adjusting lever 6. As a result, it is possible to see the orientation of the end of the arm of the adjusting lever 6 in the first climbing position. Since, in the illustration, the lever element 19 is situated behind the arm of the adjusting lever 6, the orientation of the adjusting lever 6 in relation to the orientation of the lever element 19 can also be seen.

The invention is not restricted to the automatic heel units 1 described above. Diverse variants of said automatic heel unit are possible. For example, an automatic heel unit according to the invention need not comprise a base element with a fastening plate and an intermediate element. It may for example also comprise a base element of some other type. Furthermore, the bearing of the intermediate element may be of some other form and arranged not at the rear end of the intermediate element but rather further forward in the central region or in the front region of the intermediate element.

The lever element also need not be formed as in the automatic heel unit described above. For example, the two arms of the lever element may be formed as separate elements. In this case, the automatic heel unit may comprise for example two lever elements arranged adjacent to one another. It is however also possible for the automatic heel unit to comprise only one lever element which is of lever-like form.

Furthermore, it is also possible for the adjusting lever to be of some other form. For example, the free end of the adjusting lever may be of some other form and, in the downhill position, not arranged between the climbing aids. Furthermore, the adjusting lever may also be of bar-like form rather than of horseshoe-shaped form. Furthermore, the pivot axle and the second axle may be arranged elsewhere on the adjusting lever. For example, the free end of the adjusting lever may be arranged not so as to proceed from the pivot axle but rather in the region of the second axle. In this case, it is for example possible for the pivot axle to be arranged at an end of the arms of the adjusting lever, while the second axle is arranged in a central region of the arms of the adjusting lever.

Furthermore, the free end of the adjusting lever, which can be gripped for the purpose of actuating the adjusting lever, may be arranged between the pivot axle and the second axle. For this purpose, the adjusting lever may for example comprise an elongate connecting region, at one end of which the pivot axle is arranged and at the other end of which the second axle is arranged. Here, the free end of the adjusting lever may be attached in a centre of said elongate connecting region, which free end points away from the elongate connecting region of the adjusting lever and can thereby be gripped and actuated.

Instead of the two pins as retention means, the heel retainer may also comprise one or more other retention means. The heel retainer may for example have a concave shell form as retention means by which the heel of a ski boot can be retained. In this case, the heel retainer may furthermore permit a safety release in the forward direction, as is known from downhill ski bindings and some touring ski bindings with shell-shaped retention means.

In summary, it can be stated that an automatic heel unit is provided in which the disadvantages of the already known automatic heel units as described in the introduction are eliminated.

The invention claimed is:

1. Automatic heel unit for a ski binding, having a base element for mounting the automatic heel unit on the upper side of a ski and having a carriage which is mounted on the base element so as to be movable in the longitudinal direction of the ski and on which there is arranged a heel retainer with at least one retention means for retaining a ski boot in a heel region of the ski boot , wherein a) the automatic heel unit has at least one climbing position, in which the carriage with the heel retainer is situated in a rear position and the heel region of a ski boot held in the ski binding is released, and b) the automatic heel unit has a downhill position in which the carriage with the heel retainer is situated further forward than in the at least one climbing position and the at least one retention means can interact with the heel region of a ski boot held in the ski binding in such a way that the ski boot is locked in a lowered position, wherein the automatic heel unit comprises an adjusting lever for adjusting the automatic heel unit from the downhill position into the at least one climbing position and back, during which the carriage is moved to the rear position, wherein in the downhill position the carriage is further forward than in the at least one climbing position, wherein the adjusting lever is mounted on the carriage so as to be pivotable about a pivot axle, and wherein the automatic heel unit comprises a lever element which is mounted on the base element so as to be pivotable about a first axle and mounted on the adjusting lever so as to be pivotable about a second axle.

2. Automatic heel unit according to claim 1, wherein the pivot axle, the first axle and the second axle are oriented parallel to one another.

3. Automatic heel unit according to claim 1, wherein the adjusting lever has, as viewed in a direction proceeding from the pivot axle, a free end at which the adjusting lever can be gripped and actuated.

4. Automatic heel unit according to claim 3, wherein, in the at least one climbing position, the free end of the adjusting lever is oriented rearwards and substantially parallel to the ski.

5. Automatic heel unit according to claim 3, wherein, in the downhill position, the free end of the adjusting lever points obliquely rearwards and upwards.

6. Automatic heel unit according to claim 3, wherein the pivot axle and the second axle lie in a first plane, and in that the direction in which the free end of the adjusting lever points as viewed from the pivot axle defines a straight line which intersects the first plane.

7. Automatic heel unit according to claim 1, wherein a) the pivot axle and the second axle lie in a first plane, wherein a first normal vector is oriented perpendicular to the first plane, and in the downhill position, points upwards from the first plane, and b) the first axle and the second axle lie in a second plane, wherein a second normal vector is oriented perpendicular to the second plane and, in the downhill position, points upwards from the second plane, wherein c) in the at least one climbing position, the first normal vector and the second normal vector intersect at an angle of less than 160°.

8. Automatic heel unit according to claim 1, wherein, in the downhill position of the automatic heel unit, the adjusting lever and the lever element are in a downhill configuration, wherein a) to move the automatic heel unit into the downhill position, the adjusting lever and the lever element can be pivoted relative to one another about a second axle in a first pivoting direction into the downhill configuration, wherein in a final segment of the pivoting movement into the downhill configuration, the pivot axle and the first axle are moved towards one another, and wherein b) in the downhill configuration, a further pivoting movement of the adjusting lever and of the lever element relative to one another in the first pivoting direction is blocked, whereby in the downhill position of the automatic heel unit, a further movement of the pivot axle and of the first axle towards one another is blocked.

9. Automatic heel unit according to claim 1, wherein the base element comprises a fastening element and an intermediate element, wherein the fastening element can be fastened to the ski and the intermediate element is mounted on the fastening element so as to be displaceable relative to the fastening element in the longitudinal direction of the ski.

10. Automatic heel unit according to claim 9, wherein the first axle is mounted on the intermediate element.

11. Automatic heel unit according to claim 9, wherein, in the downhill position, the intermediate element is movable dynamically relative to the base element in the longitudinal direction of the ski along a region.

12. Automatic heel unit according to claim 11, wherein, in the downhill position, the intermediate element is acted on with a forwardly directed force, and pushed in the direction of a forward end of the dynamic region, by an elastic element.

13. Automatic heel unit according to claim 1, wherein the automatic heel unit comprises, as retention means, two pins which protrude in a forward direction from the heel retainer.

14. A touring ski binding having the automatic heel unit according to claim 1.

15. A touring ski having the ski binding according to claim 14.

* * * * *